United States Patent [19]

Masuda et al.

[11] 4,359,524

[45] Nov. 16, 1982

[54] HEAT DEVELOPABLE PHOTOSENSITIVE MATERIAL

[75] Inventors: Takao Masuda; Itsuo Fujiwara; Yoshimasa Aotani; Isamu Itoh, all of Minami-ashigara, Japan

[73] Assignee: Fuji Photo Film Co., Ltd., Kanagawa, Japan

[21] Appl. No.: 283,413

[22] Filed: Jul. 15, 1981

[30] Foreign Application Priority Data

Jul. 15, 1980 [JP] Japan ..... 55-96340

[51] Int. Cl.[3] ..... G03C 1/84

[52] U.S. Cl. ..... 430/522; 430/618; 430/619; 430/620; 430/339

[58] Field of Search ..... 430/522, 618, 619, 620, 430/339, 338, 343, 344

[56] References Cited

U.S. PATENT DOCUMENTS

| | | | |
|---|---|---|---|
| 3,104,973 | 9/1963 | Sprague et al. | 430/339 |
| 3,148,187 | 9/1964 | Heseltine | 430/522 |
| 3,595,655 | 7/1971 | Robinson et al. | 430/339 |
| 3,615,562 | 10/1971 | Harrison | 430/339 |
| 3,984,248 | 10/1976 | Sturmer | 430/522 |
| 4,232,106 | 11/1980 | Iwasaki et al. | 430/344 |
| 4,258,123 | 3/1981 | Nagashima et al. | 430/343 |

OTHER PUBLICATIONS

Research Disclosure 17029, Jun. 1978.

*Primary Examiner*—Won H. Louie, Jr.
*Attorney, Agent, or Firm*—Sughrue, Mion, Zinn, Macpeak & Seas

[57] ABSTRACT

A heat-developable photosensitive material is described comprising a heat-developable photosensitive layer containing at least an organic silver salt, a photocatalyst, and a reducing agent, wherein the improvement is an antihalation layer comprising a light bleachable colored composition composed of at least (1) a photosensitive halogen-containing compound, and (2) a merocyanine dye, provided on the opposite side of said heat-developable photosensitive layer with respect to the side intended for imagewise exposure.

13 Claims, No Drawings

HEAT DEVELOPABLE PHOTOSENSITIVE MATERIAL

FIELD OF THE INVENTION

The present invention relates to a heat-developable photosensitive material, and particularly to a heat-developable photosensitive material which forms sharp images.

BACKGROUND OF THE INVENTION

Heat-developable photosensitive materials having a heat-developable photosensitive layer containing at least an organic silver salt, a photocatalyst and a reducing agent have been described, for example, in U.S. Pat. Nos. 3,152,904 and 3,457,075. These heat-developable photosensitive materials have advantages that they have excellent gradation and high sensitivity as compared with other dry-type photographic processes, such as an electrophotographic process, a diazo photographic process, a foaming photographic process, or a heat-sensitive photographic process utilizing a coloring reaction of a leuco dye. In these heat-developable photosensitive materials, the image is obtained by imagewise exposure to light so that said photocatalyst is able to catalyze an oxidation-reduction reaction of said organic silver salt with the reducing agent under heating, and thereafter heating (generally to 80° C. or more, and preferably to 120° C. or more). In this photosensitive system, since the photocatalyst having photosensitivity is used in a very small amount, there is hardly any interference when viewing, even if the sensitive material is allowed to remain exposed to light without carrying out fixation or stabilization after the development.

However, one of the faults of these heat-developable photosensitive materials is that the image becomes blurred by halation. In the conventional silver halide photographic materials, which are subjected to a wet processing, this problem has been overcome by providing an antihalation layer, which is bleached or removed by liquid processing after exposure, located on the back of the base or between the base and the emulsion layer. However, an antihalation layer which is bleached or removed by liquid processing is not useful for a heat-developable photosensitive materials, because the heat-developable photosensitive materials are intended to be processed by heating only.

Accordingly, in order to prevent halation of the heat-developable photosensitive materials, it is necessary to use an antihalation layer which can be bleached or removed by a dry processing. Techniques proposed heretofore include the following:

(1) A method which comprises using a colored layer capable of being mechanically stripped as the antihalation layer, as described in Japanese patent publication No. 33692/73.

(2) A method which comprises using a colored layer containing a dye which is bleached by heat as the antihalation layer, as described in U.S. Pat. Nos. 3,769,019, 4,033,948, 4,088,497, 4,153,463 and 3,821,001 and Japanese Patent Application (OPI) No. 56818/79.

(3) A method which comprises using a colored layer containing o-nitro-arylidene dyes or o-nitro-o-aza-arylidene dyes, which are bleached by light, as the antihalation layer, as described in Japanese patent application (OPI) No. 17833/79.

However, the method (1) requires an additional processing apparatus for the sole purpose removing the antihalation layer, and there is also the possibility of damaging the base during the stripping operation. On the other hand, in method (2), there is a possibility of causing bleaching before the processing or during preservation, depending on the temperature, or there is possibility of causing excess heat fogging. Further, in the method (3), there is a possibility of causing light discoloration of the heat-developable photosensitive layer because a large quantity of light is required for the decoloration, and there is a problem of selection of appropriate dyes having a desired absorptive wavelength, and synthesis of such dyes are difficult.

SUMMARY OF THE INVENTION

Accordingly, an object of the present invention is to provide a heat-developable photosensitive material having high image sharpness which comprises an antihalation layer which is very stable during preservation before the processing, but can be easily bleached by light when desired without causing heat fogging and light discoloration.

Another object of the present invention is to make possible selection from a wide range a dyes which give an absorption characteristic in a desired wavelength to the light-bleachable antihalation layer.

The present invention has now attained the above described objects. Particularly, the present invention is a heat-developable photosensitive material comprising a heat-developable photosensitive layer containing as least an organic silver salt, a photocatalyst and a reducing agent, wherein the improvement is an antihalation layer comprising a light bleachable colored composition composed of at least (1) a photosensitive halogen containing compound, and (2) a merocyanine dye, provided on the opposite side of said heat-developable photosensitive layer with respect to the side intended for imagewise exposure.

DETAILED DESCRIPTION OF THE INVENTION

As is described above, the antihalation layer of the present invention is provided on the opposite side of the heat-developable photosensitive layer with respect to the incident side to which imagewise exposing light is applied. In greater detail, the light-bleachable colored composition layer composed of the components (1) and (2) is provided between the heat-developable photosensitive layer and the base or on the back of the base, or the light bleachable colored composition is added to the base so that the base itself has an antihalation ability. The above described light bleachable colored composition layer is preferably formed by applying a dispersion of the components (1) and (2) in a suitable binder, but, if desired, it may be formed by applying a solution of the components (1) and (2) in a binderless state. As the binder, it is possible to use the same kind of binder as that used for the heat-developable photosensitive layer, a protective coating layer, or a subbing layer.

It is preferred that the polymeric material as the binder be those which form a transparent or semitransparent colorless layer or membrane when they are applied. Examples include protains such as gelatin, cellulose derivertives such as diacetyl cellulose, polysaccharides such as dextran and natural polymeric materials such as gum arabic, and synthetic polymeric materials described in U.S. Pat. No. 4,009,039, and Japanese patent application (OPI) Nos. 12408/75, 29126/76, 19525/76 and 84443/74, examples include polyvinyl acetate, vinylidene chloride-vinylchloride copolymer, polyvinyl butyral, polymethyl methacrylate, vinylchloride-vinylacetate copolymer, polyvinyl alcohole, etc.

The antihalation layer of the present invention prevents halation by absorbing light passing through the heat-developable photosensitive layer during image exposure by the merocyanine dye included as the component (2) and becomes transparent (light-bleached) by decoloration of the merocyanine dye due to a function of a halogen radical or hydrohalogenic acid formed by light decomposition of the photosensitive halogen containing compound included as the component (1) by uniform light exposure after the heat development.

The photosensitive halogen containing compound as the component (1) in the light bleachable colored composition used for the antihalation layer of the present invention is an organic compound which is decomposed by application of light to release a halogen radical or hydrohalogenic acid. Such compounds have been known and are described, for example, in U.S. Pat. No. 3,902,903, British Pat. No. 1,432,138 and Japanese patent application (OPI) Nos. 120328/75, 119624/75 and 24113/80, etc. In the present invention, these known photosensitive halogen containing compounds can be adopted as the component (1) by suitably selecting from the known compounds corresponding to the merocyanine dye used.

Typical examples of the photosensitive halogen containing compounds capable of using as component (1) of the antihalation layer according to the present invention include the following compounds.

1. Compounds represented by formula (I):

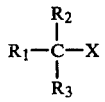

(I)

wherein X represents a halogen atom, $R_1$, $R_2$, and $R_3$, which may be same or different, each can represent hydrogen, a halogen atom, a nitro group, an alkyl group having from 1 to 10 carbon atoms, an aryl group having from 6 to 14 carbon atoms, an alkylcarbonyl group having from 2 to 11 carbon atoms, an arylcarbonyl group having from 7 to 15 carbon atoms, an amido group substituted with an alkyl group having from 1 to 10 carbon atoms or an aryl group having from 6 to 14 carbon atoms, or a sulfonate group substituted with an alkyl group having from 1 to 10 carbon atoms or an aryl group having from 6 to 14 carbon atoms (the alkyl group and the aryl group in these groups may be substituted with halogen atoms, a hydroxyl group, a nitro group, alkyl groups, aryl groups, alkoxy groups, carbamate groups, carbonate groups, sulfonate groups and carboxylate groups, etc.), and $R_1$ and $R_2$ together can also form a cycloalkyl ring by linking to each other.

Examples of compounds included in formula (I) include carbon tetrabromide, tetrabromobutane, hexabromocyclohexane, α-chloro-p-nitrotoluene, iodoform, hexabromoethane, benzotrichloride, α-bromo-p-nitrotoluene, α-bromo-m-nitrotoluene, α,α'-dibromo-o-xylene, α,α'-dibromo-p-xylene, α,α,α',α'-tetrabromoxylene and tribromoethyl cinnamate; compounds represented by the formula:

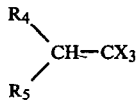

(wherein $R_4$ represents an alkyl group or an aryl group, $R_5$ represents a hydroxyl group, an alkoxy group, a carbamate group, a carbonate group, a sulfonate group, a phosphate group or a carboxylate group, and X represents a halogen atom; examples of which include 2,2,2-tribromoethanol, 2,2,2-tribromoethylcyclohexane carbamate, 2,2,2-tribromoethylbenzene carbamate, 2,2,2-tribromoethyl benzoate, 2,2,2-tribromoethyl ethylcarbonate, 2,2-dibromo-3-chloro-1-phenylethanol, 2-methyl-1,1,1-tribromo-2-propanol, bis(2,2,2-tribromoethoxy)diphenyl methane, p-toluenesulfonyl tribromoethyl urethane, 2,2,2-tribromoethyl stearate, 2,2,2-tribromoethyl furoate and bis(2,2,2-tribromoethyl) succinate, etc.), compounds represented by the formula:

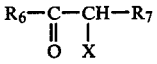

(wherein $R_6$ represents an amino group, an alkyl group having from 1 to 10 carbon atoms or an aryl group having from 6 to 14 carbon atoms, $R_7$ represents hydrogen, an alkyl group having from 1 to 10 carbon atoms, or an acyl group having from 1 to 10 carbon atoms, and X represents a halogen atom; examples of which include 2-bromoacetophenone, 2-bromo-2-phenylacetophenone, 2-bromo-1,3-diphenyl-1,3-propanedione, α-bromo-2,5-dimethoxyacetophenone, α-bromo-γ-nitro-β-phenylbutyrophenone, α-iodo-γ-nitro-β-phenylbutyrophenone, 2-bromo-p-phenylacetophenone, 2-chloro-p-phenylacetophenone, 2-bromo-p-bromoacetophenone, 1,3-dichloroacetone and 2,2'-dichloro-4-chloromethylcarbonamidobenzophenone, etc.), compounds represented by the formula:

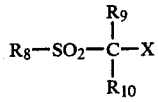

(wherein $R_8$ represents an aryl group having from 6 to 12 carbon atoms or a benzothiazole group, $R_9$ and $R_{10}$, which may be some or different each represents hydrogen, a halogen atom, an alkyl group having from 1 to 5 carbon atoms, or an amido group having from 1 to 11 carbon atoms, and X represents a halogen atom; examples of which include 2-bromo-2-phenylsulfonyl acetamide, 2-bromo-2-(p-tolyl-sulfonyl)acetamide, 2-tribromomethylsulfonyl benzothiazole, dibromomethylsulfonyl benzene and tribromomethylsulfonyl benzene, etc.), and compounds represented by the formula:

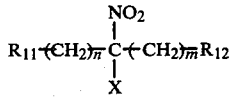

(wherein n and m each represent an integer of 1 to 5, $R_{11}$ and $R_{12}$ each represents

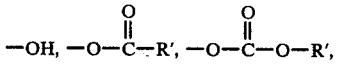

or —$SO_2$—R′ (wherein R′ represents an alkyl group having from 1 to 5 carbon atoms or an aryl group having from 6 to 12 carbon atoms), and X represents a halogen atom; examples of which include 2-bromo-2-nitro-1,3-propanediol, 1,3-dibenzoyloxy-2-bromo-2-nitropropane and 2-bromo-2-nitrotrimethylene-bis(phenylcarbonate), etc.).

2. Compounds represented by formula (II):

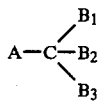

(II)

wherein A represents a heterocyclic ring, which may have substituents, and $B_1$, $B_2$, and $B_3$ each represents an atom selected from hydrogen, chlorine, and bromine, provided that at least one of $B_1$, $B_2$, and $B_3$ is a chlorine atom or a bromine atom.

Examples include the compounds described in U.S. Pat. No. 3,902,903 such as ω,ω,ω-tribromoquinaldine, ω,ω-dibromoquinaldine, 2-ω,ω,ω-tribromomethyl-4-methylquinaldine or ω,ω-dichloromethylquinoline, etc.

3. Compounds represented by formula (III):

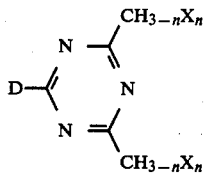

(III)

wherein D represents an alkyl group having from 1 to 5 carbon atoms, which may be substituted with halogen atoms or an aryl group having from 6 to 10 carbon atoms, and n represents an integer of 1 to 3.

Examples thereof include 2,4-bis(tribromomethyl)-6-methyltriazine, 2,4,6-tris(dibromomethyl)triazine, 2,4,6-tris(tribromomethyl)triazine, 2,4,6-tris(trichloromethyl)triazine, 2,4-bis(trichloromethyl)-6-methyltriazine, and 2,4-bis(trichloromethyl)-6-phenyltriazine, etc.

4. Compounds represented by formula (IV):

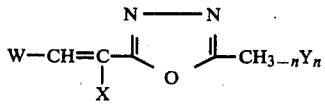

(IV)

wherein W represents a substituted or un-substituted phenyl group or a substituted or un-substituted naphthyl group, wherein the phenyl group may be substituted with halogen atoms, a nitro group, a cyano group, an alkyl group having from 1 to 3 carbon atoms or an alkoxy group having from 1 to 4 carbon atoms. Further, the phenyl group may have the structure

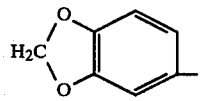

wherein two alkoxy groups form a ring.

The number of substituents is 1 or 2 in the case of halogen atoms, and is 1 in other cases. X represents hydrogen, an alkyl group having from 1 to 3 carbon atoms, or a phenyl group. Y represents a halogen atom. n represents an integer of 1 to 3.

Examples of compounds of formula (IV) include the following compounds described in Japanese Patent Application (OPI) No. 24113/80.

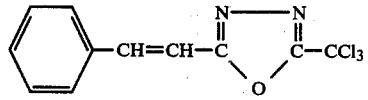

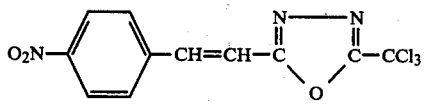

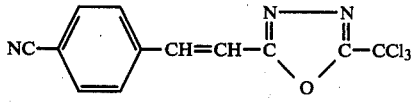

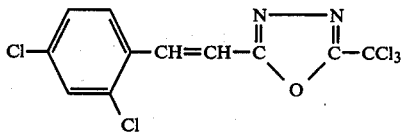

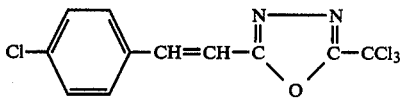

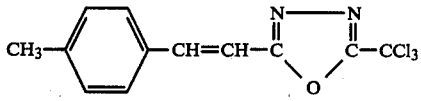

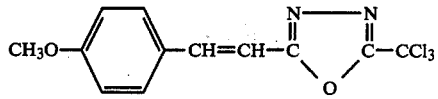

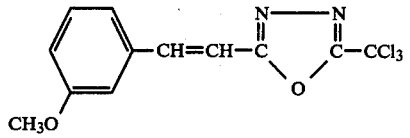

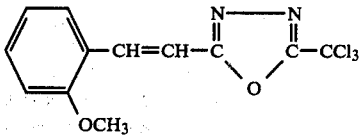

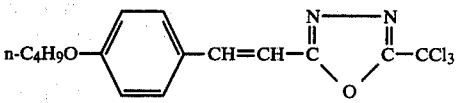

-continued

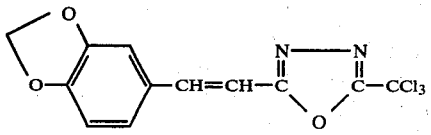

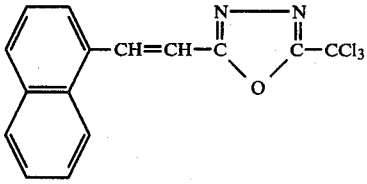

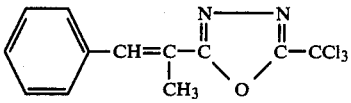

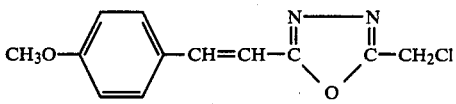

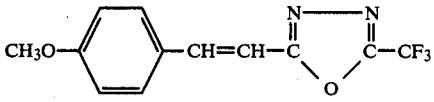

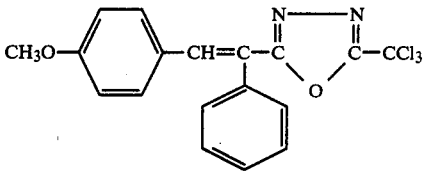

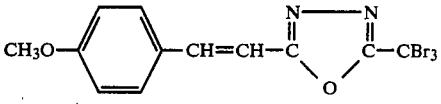

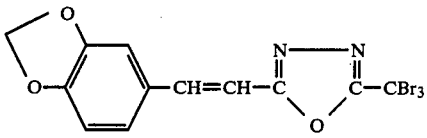

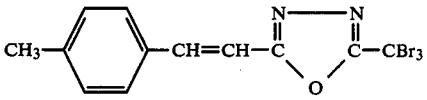

The foregoing photosensitive halogen containing compounds should be used in an amount sufficient to bleach the merocyanine dye by means of halogen radical formed by exposing the compound to absorbable light or by hydrohalogenic acid formed by the halogen radical. Generally, a suitable amount can be easily determined by applying the combination of them with the merocyanine dye in various amounts. However, it is generally preferable to use the photosensitive halogen containing compound in an amount of from 0.1 mols to 100 mols, and preferably from 1 mol to 10 mols, per mol of the merocyanine dye.

The merocyanine dye included as the component (2) of the present invention is a dye having a basic nucleus and an acid nucleus which has a resonance structure that can be represented by

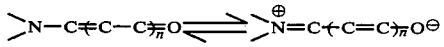

wherein n is a positive integer, which is dye having an absorption region in the sensitive wavelength range of the heat-developable photosensitive layer.

Merocyanine dyes suitably used in the present invention are those which have a thiazoline nucleus, an oxazoline nucleus, a pyrroline nucleus, a pyridine nucleus, an oxazole nucleus, a thiazole nucleus, a selenazole nucleus, a tetrazole nucleus, or an imidazole nucleus as the basic nucleus, and a thiohydantoin nucleus, a rhodanine nucleus, an oxazolidinedione nucleus, a thiazolidinedione nucleus, a barbituric acid nucleus, a thiazolinone nucleus, a malonitrile nucleus, or a pyrazolone nucleus as an acid nucleus. These merocyanine dyes are known, and can be suitably selected by reference to descriptions, for example, in *The Theory of the Photographic Process,* 3rd Ed. (1967) pages 218–227, by Mees and James, and *The Cyanine Dyes and Related Compounds* (1964) by F. M. Hamer.

It is preferred in the present invention that the merocyanine dye be used in an amount sufficient to make the transmission optical density of the antihalation layer at least 0.1 and preferably at least 0.3 to make the reflection optical density at least 0.05, and preferably at least 0.1.

Examples of particularly suitable merocyanine dyes used in the present invention are described below:

(1)

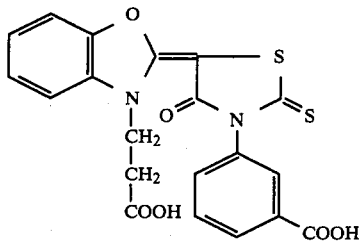

(2)

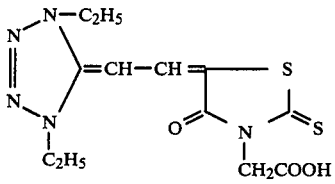

(3)

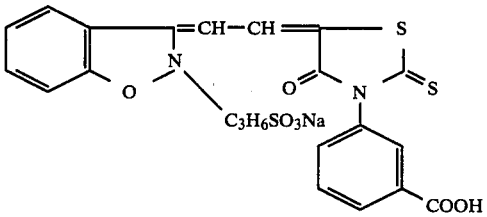

(4)

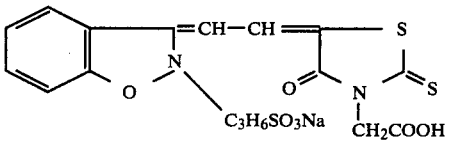

-continued
(5)
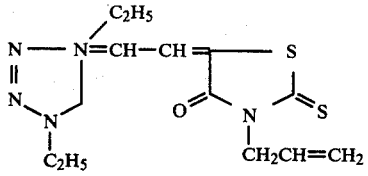
(6)
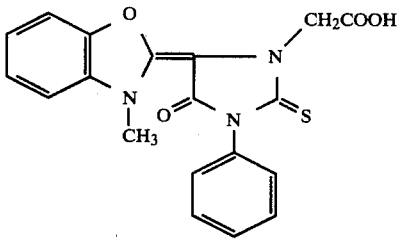
(7)
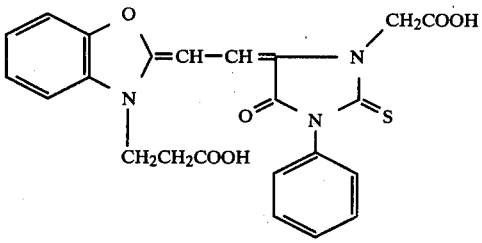
(8)
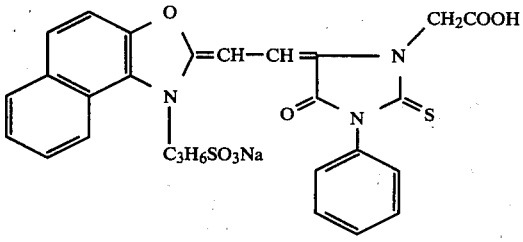
(9)
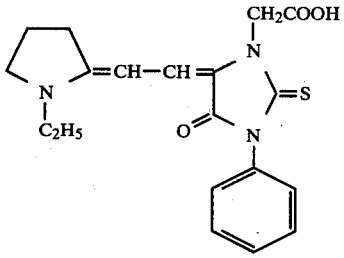
(10)
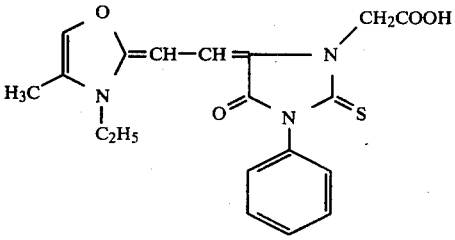
-continued
(11)
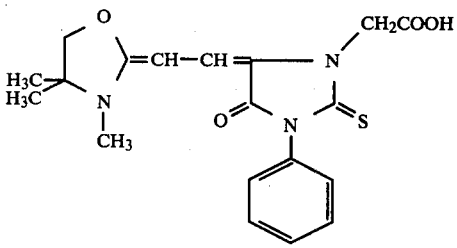
(12)
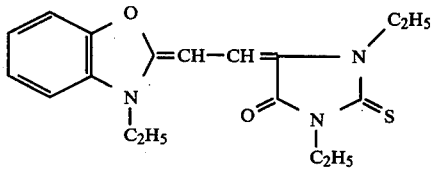
(13)
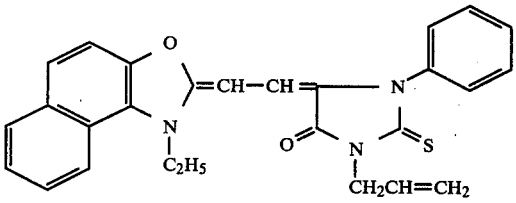
(14)
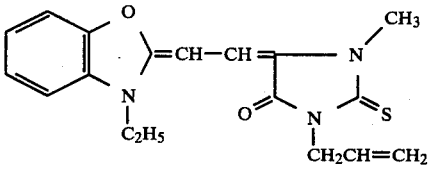
(15)
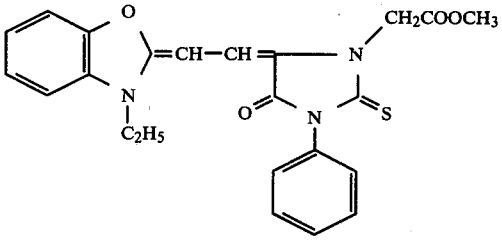
(16)
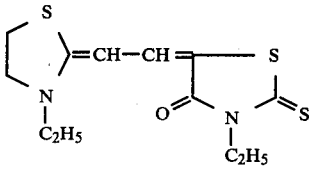
(17)
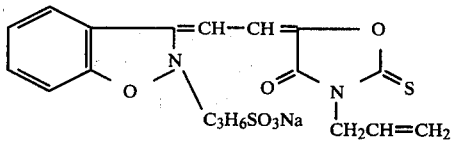

-continued
(18)
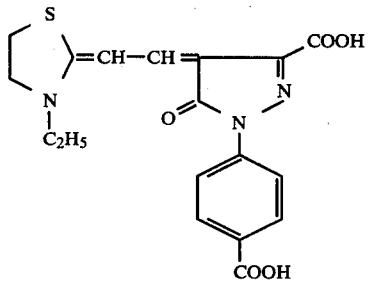
(19)
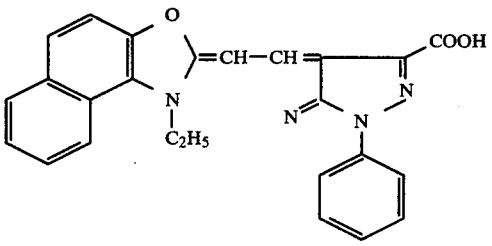
(20)
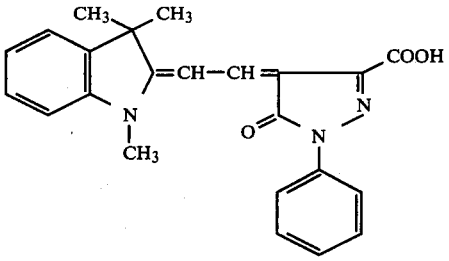
(21)
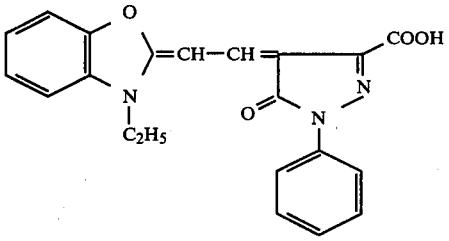
(22)
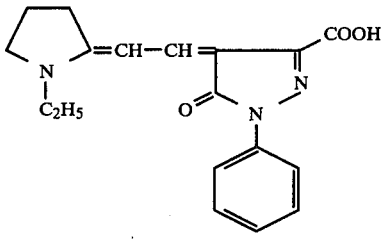
(23)
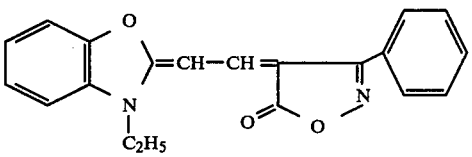
(24)
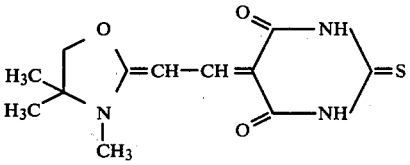
-continued
(25)
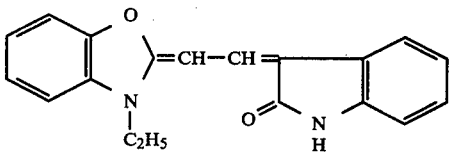
(26)
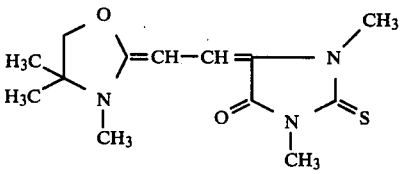
(27)
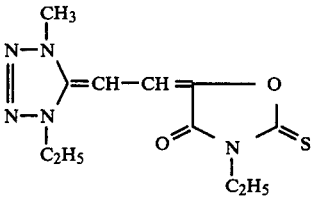
(28)
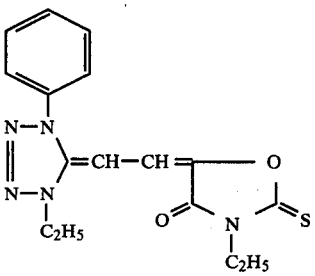
(29)
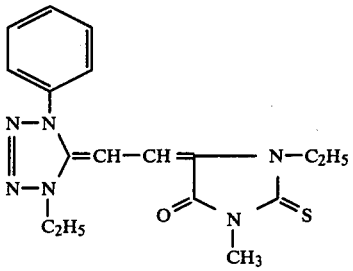
(30)
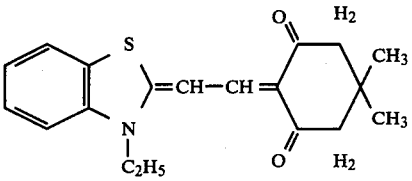
(31)
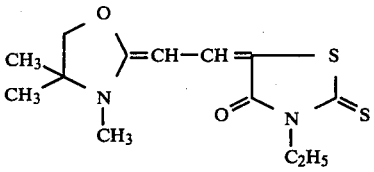
(32)
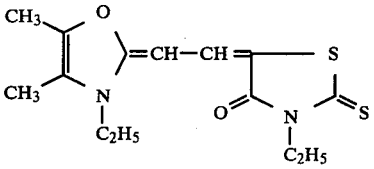

-continued (33)

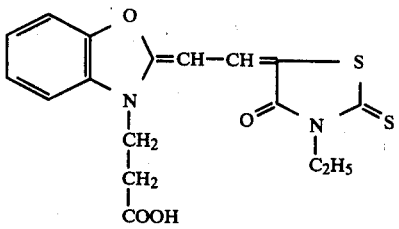

(34)

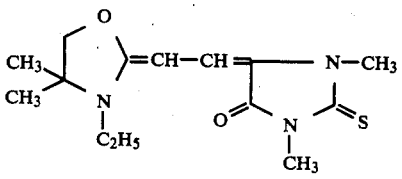

(35)

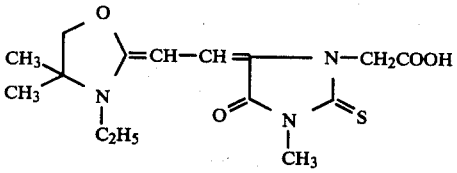

(36)

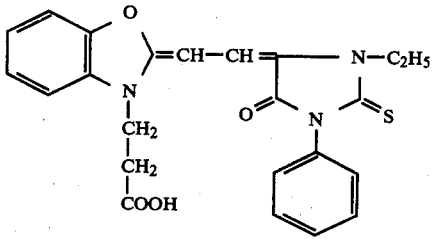

(37)

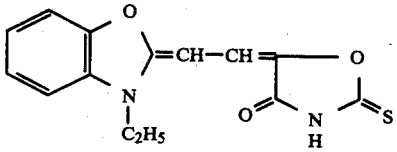

(38)

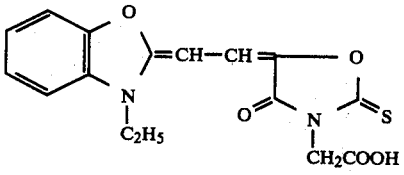

(39)

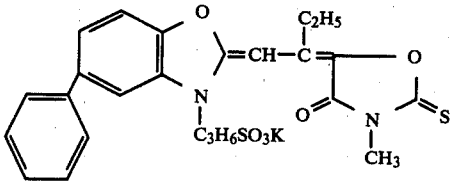

(40)

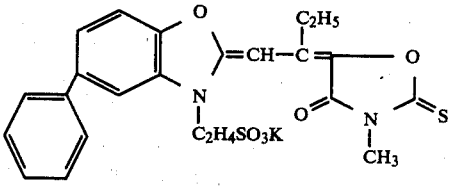

-continued (41)

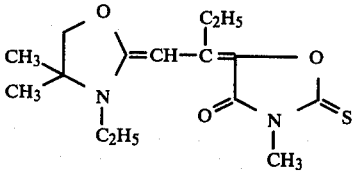

(42)

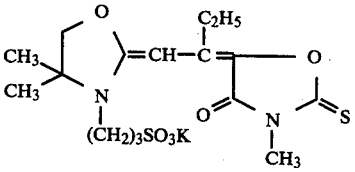

(43)

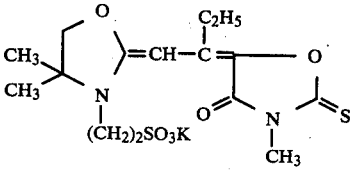

(44)

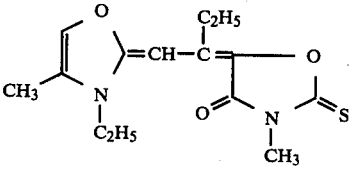

The organic silver salt of the heat-developable photosensitive layer used in the present invention is colorless, white or light colored in a normal state, but reacts with the reducing agent to form silver (image) when it is heated to 80° C. or more in a presence of an exposed photo-catalyst, which fulfils the function of an image forming component in the heat-developable photosensitive material. As such organic silver salts, silver salts of organic compounds having an imino group, a mercapto group, a thione group or a carboxyl group have been known, and examples have been described, for example, in U.S. Pat. Nos. 3,457,075, 3,549,379, 3,785,830, 3,933,507 and 4,009,039, British Pat. No. 1,230,642, and Japanese patent application (OPI) Nos. 93139/75, 99719/75, 22431/76, 141222/77 and 36224/78. These known organic silver salts can be used as an organic silver salt of the present invention by suitably selecting from among them.

As preferred organic silver salts used in the present invention, there are silver salts of long chain aliphatic carboxylic acids having from 10 to 40 carbon atoms, and preferably from 18 to 33 carbon atoms, examples of which include silver laurate, silver myristate, silver palmitate, silver stearate, silver arachidate, silver behenate, silver lignocerate, silver pentacosanate, silver cerotate, silver heptacosanate, silver montanate, silver melissate and silver laccerate, etc. These silver salts of aliphatic carboxylic acids may be used together with reactive free aliphatic acids.

Of the above described organic silver salts, it is preferred to use those having a particle size of about 0.01 microns to 10 microns, and preferably from about 0.1 microns to about 5 microns.

The organic silver salt in the present invention is used in an amount of from about 0.1 g to 4 g, and, preferably, from about 0.2 g to 2.5 g of silver content based on 1 $m^2$ of the base. This amount is necessary and sufficient to give a suitable image density. If the amount is less than the above described range, the image density is insufficient. If it is larger than the above described range, the image density is not increased, but the cost becomes high.

The photocatalyst of the heat-developable photosensitive layer used in the present invention is a substance which changes into a substance catalyzing a silver (image) forming reaction of the organic silver salt with the reducing agent present in the layer under heating to 80° C. or more, or a substance having an ability of releasing such a substance with exposure of electromagnetic radiation, which functions as a photosensitive component and a catalyst component for the above described silver (image) forming reaction in the heat-developable photosensitive material. Examples of such photocatalysts, include inorganic and organic photoconductive substances such as zinc oxide or titanium oxide, etc., photosensitive complexes of silver and dyes, and photosensitive silver salts such as photosensitive silver halide. Generally, they are used in an amount of from about 0.001 mol to 1 mol, and, preferably, from about 0.01 mol to 0.5 mol, per 1 mol of the organic silver salt.

The most suitable photocatalyst used in the present invention is photosensitive silver halide, examples of which include silver chloride, silver bromide, silver iodide, silver chlorobromoiodide, silver chlorobromide, silver chloroiodide, silver iodobromide and mixtures thereof. Preferred particle size of the photosensitive silver halide is from about 0.05 micron to 0.2 micron.

The photosensitive silver halide used in the present invention can be formed simultaneously with formation of the organic silver salt by introducing a silver ion solution into a mixed solution containing a halogenating agent and an organic silver salt forming component, as described in British Pat. No. 1,447,454.

Further, as another process, a part of the organic silver salt may be converted into the photo-sensitive silver halide by reacting a photosensitive silver halide forming component with a previously prepared solution or dispersion of the organic silver salt or with a sheet material containing the organic silver salt. Thus formed photosensitive silver halide exhibits a particularly preferred function for the present invention because it effectively contacts the organic silver salt. The foregoing expression "photosensitive silver halide forming component" refers to a compound capable of forming photosensitive silver halide by reacting with the organic silver salt, and effective compounds corresponding to it can be distinguished by the following simple test. Namely, after an organic silver salt and a compound to be tested are mixed, and, if necessary, heated in order to accelerate the decomposition of the mixture and the reaction of the organic silver salt and the halogen radical (or ion), particular diffraction peaks of silver halide are investigated by X-ray diffractiometry. Examples of photosensitive silver halide forming components whose effectiveness has been ascertained by such a test include inorganic halides, onium halides, halogenated hydrocarbons, N-halogenated compounds, halogen molecules and other halogen containing compounds, examples of which have been described in U.S. Pat. Nos. 4,009,039, 3,457,075 and 4,003,749, British Patent 1,498,956 and Japanese patent application (OPI) Nos. 27027/78, 25420/78, 131029/78 and 114419/78.

The photosensitive silver halide forming component is used in a stoichiometrically small amount compared to the amount of organic silver salt. Generally, the amount is settled in a range of from about 0.001 mol to 0.7 mol, and, preferably, from about 0.01 mol to 0.5 mol, par 1 mol of the organic silver salt. Two or more kinds of photosensitive silver halide forming component may be used within the above described range. It is particularly preferred to use oxidative halogen containing compounds such as N-halogen compounds or halogen molecules together with inorganic halides because of showing high sensitivity and low fog.

Further, it is preferred to use an oxidizing agent such as hydrogen peroxide, etc., together with the photosensitive silver halide forming component.

The photocatalyst can be spectrally sensitized by various known dyes. Examples of effective spectral sensitizing dyes include cyanine dyes, merocyanine dyes, rhodacyanine dyes, complex (3 nuclei or 4 nuclei) cyanine or merocyanine dyes, holopolar cyanine dyes, styryl dyes, hemicyanine dyes, oxonol dyes, hemioxonol dyes, and xanthene dyes. As the cyanine dyes, those having a basic nucleus such as a thiazoline nucleus, an oxazoline nucleus, pyrroline nucleus, a pyridine nucleus, an oxazole nucleus, a thiazole nucleus, a selenazole nucleus, or an imidazole nucleus are preferred. As the merocyanine dyes, those having a thiohydantoin nucleus, a rhodanine nucleus, an oxazolidinedione nucleus, a thiazolidinedione nucleus, a barbituric acid nucleus, a thiazolinone nucleus, a malonitrile nucleus, a tetrazole nucleus or a pyrazolone nucleus as an acid nucleus together with the above described basic nucleus are preferred. Among them, merocyanine dyes having an imino group or a carboxyl group are particularly effective. More specifically, the dye is suitably selected from known dyes described, for example, in U.S. Pat. Nos. 3,761,279, 3,719,495 and 3,877,943 and British Pat. Nos. 1,466,201, 1,469,117 and 1,422,057, etc., and these dyes can be positioned near the photocatalyst according to the method described above known literatures (or patents). These spectral sensitizing dyes are used in an amount of from about $10^{-4}$ mol to 1 mol per mol of the photocatalyst.

The reducing agent of the heat-developable photosensitive layer used in the present invention is a substance which reacts with the organic silver salt to reduce it when heated to 80° C. or more in a presence of an exposed photocatalyst, which functions as an oxidation-reduction image forming composition together with the organic silver salt in the heat-developable photosensitive material. A suitable reducing agent is decided on the basis of the kind and properties of the organic silver salt used. For example, a reducing agent having a high reducing ability is suitable for organic silver salts which are difficult to reduce, and a reducing agent having a low reducing ability is suitable for organic silver salts which are easily reduced.

Examples of generally known reducing agents used for the heat-developable photosensitive material, include monophenols, polyphenols having two or more phenol groups, mononaphthols, bisnaphthols, polyhydroxybenzenes having two or more hydroxyl groups, polyhydroxynaphthalenes having two or more hydroxyl groups, ascorbic acid compounds, 3-pyrazolidones, pyrazoline-5-ones, pyrazolones, phenylenediamines, hydroxylamine, hydroquinone monoethers, hydroxamic acids, hydrazides, amidoximes and N-hydroxyureas, etc. In more detail, such reducing agents are described, for example, in U.S. Pat. Nos. 3,615,533, 3,679,426, 3,672,904, 3,751,252, 3,782,949, 3,801,321, 3,794,949, 3,801,321, 3,794,488, 3,893,863, 3,887,376, 3,770,448, 3,819,382, 3,773,512, 3,928,686, 3,839,048, 3,887,378, 4,009,039 and 4,021,249, British Pat. No. 1,486,148, Belgium Pat. No. 786,086, Japanese patent applications (OPI) Nos. 36143/75, 36110/75, 116023/175, 99719/75, 140113/75, 51933/76, 23721/76 and84727/77, and Japanese patent publication No. 35851/76. The reducing agent used in the present invention can be suitably selected from these known reducing agents. It is believed that the simplest method of selection is that which comprises producing a heat-developable photosensitive material and examining superiority or inferiority of the reducing agent used by evaluating photographic properties of the heat-developable photosensitive material. Many useful materials have been developed in the art by this method.

The amount of the reducing agent used in the present invention varies according to the kinds of the organic silver salt and the reducing agent and use of other additives, but it is generally in a range of from about 0.05 mol to 10 mols and, preferably, from about 0.1 to 3 mols, per mol of the organic silver salt. Further, two or more kinds of reducing agent may be used together within the above described range.

It is desirable to use a toning agent, a tone affording agent or an additive called a activator toner (referred to simply as the toner hereinafter) together with the above described each component. The toner has a function of increasing density, and, particularly, blackening the formed image by participating in an oxidation-reduction silver (image) forming reaction of the organic silver salt with the reducing agent. As the toner, many compounds are known already, most of which are compounds having an imino group, a mercapto group, or a thione group. A suitable toner is selected from them according to the kinds of the organic silver salt and the reducing agent. Examples of toners which show a suitable toning effect in the present invention include phthalazinones (for example, phthalazinone, 2-acetylphthalazinone and 2-carbamoylphthalazinone, etc.) described in U.S. Pat. Nos. 3,152,904, 3,844,797 and 4,076,534. In addition, there are heterocyclic compounds described in U.S. Pat. Nos. 3,846,136, 4,030,930, 3,846,136, 3,951,660 and 3,885,967, Japanese patent application (OPI) No. 76020/78, and U.S. Pat. No. 3,782,941. These toners may be used as a combination of two or more thereof.

Further, phthalic acid, naphthoic acid or phthalamic acid and imidazoles or phthalazines may be used together as the toner, as described in U.S. Pat. Nos. 3,847,612 and 3,994,732.

When using toner, it is preferred to use it in an amount of from about 0.0001 mol to 2 mols, and, preferably from 0.0005 mol to 1 mol, per mol of the organic silver salt.

In order to remove fog generating on the non-image area during heat development, (referred to as heat-fog hereinafter), it is possible to use various compounds in the present invention.

Suitable anti-heat-fogging agents include (1) N-halogenated compounds (for example, N-halogeno succinimide and N-halogenoacetamide) described in U.S. Pat. Nos. 3,957,493 and 4,055,432, (2) perchlorates, peroxides, and persulfates, described in British Pat. Nos. 1,455,271 and 1,460,868, (3) lithium salt of aliphatic acids, described in U.S. Pat. No. 3,885,968, (4) rhodium salts, iron salts, cobalt salts, nickel salts and palladium salts described in British Pat. Nos. 1,480,704 and 1,502,670 and Japanese patent application (OPI) No. 134421/75, (5) polymer acids (for example, polyacrylic acid) described in U.S. Pat. No. 4,039,334 and Japanese patent application (OPI) No. 104338/76, (6) 1,2,4-triazoles described in Japanese patent application (OPI) No. 32015/78, (7) sulfinic acids or thiosulfonic acid described in Japanese patent application (OPI) No. 78227/76, (8) disulfides described in Japanese patent application (OPI) No. 93149/80, (9) sulfur simple substance described in U.S. Pat. No. 4,036,650, (10) cerium compounds described in Japanese Patent Application (OPI) No. 24520/77, and (11) mercapto compounds and thiones useful for gelatin-silver halide. Among them, thiosulfonic acids of (7), sulfur simple substance of (9), cerium compounds of (10), 1,2,4-triazoles of (6) and mercapto compounds and thiones of (11) show very useful effects.

The above-described ingredients of the present invention is preferred to be dispersed in at least one kind of colloid as a binder. Preferred binders are hydrophobic polymeric materials. However, if desired, hydrophilic polymeric materials may be used alone or together with the above described binders. It is preferred that the polymeric materials used as the binder be those which form a transparent or semitransparent colorless layer or membrane when they are applied. Examples include proteins such as gelatin, cellulose derivatives, polysaccharides such as dextran and natural polymeric materials such as gum arabic, and synthetic polymeric materials described in U.S. Pat. No. 4,009,039, and Japanese patent application Nos. 126408/75, 29126/76, 19525/76 and 84443/74. Among them, it is particularly preferred to use polyvinyl butyral, polyvinyl acetate, ethyl cellulose, vinylidene chloride-vinyl chloride copolymer, polymethyl methacrylate, vinyl chloride-vinyl acetate copolymer, cellulose acetate butyrate, gelatin, and polyvinyl alcohol. If desired two or more of these materials may be used together. The most suitable binder for the photosensitive layer is polyvinyl butyral. These polymeric materials are used in an amount sufficient to support components dispersed therein, namely, an amount effective as the binder. The amount thereof can be suitably decided by persons skilled in the art. For example, in case of dispersing at least the organic silver salt, they are used in a ratio by weight of about 10:1 to 1:10, and preferably from about 4:1 to 1:4 based on weight of the organic silver salt.

The composition comprising the organic silver salt, photocatalyst and reducing agent of the present invention is applied as a mono-layer or two or more layers to various bases selected from broad kinds of material to form a photosensitive layer. Materials useful for the base include various kinds of polymeric material, glass, woolen cloth, paper and metal (for example, aluminium), etc. But materials capable of forming a flexible sheet or roll are suitable in the viewpoint of handling as an information recording material. Accordingly, as the base in the present invention, it is particularly preferred to use plastic films (for example, a cellulose acetate film, a polyester film, a polyethylene terephthalate film, a polyamide film, a polyimide film, a triacetate film or a polycarbonate film) and papers (conventional paper as well as photographic base paper, printing base paper such as coated paper or art paper, baryta paper, resin coated paper, paper sized with polysaccharide as described in Belgium Patent 784,615, pigmented paper containing pigments such as titanium dioxide, etc., and paper sized with polyvinyl alcohol).

In the heat-developable photosensitive materials of the present invention, it is possible to provide various assistant layers, for example, an antistatic layer or a subbing layer as described in Japanese Patent Application (OPI) Nos. 87721/78, in addition to the antihalation layer. Further, it is preferred to provide a protective polymer layer as described in U.S. Pat. Nos. 3,933,508, 3,856,526, 3,856,527 and 3,893,860, because the layer provides an effect of increasing transparency of each layer provided on the base and improving moisture resistance and heat resistance of the layer. The protective polymer layer is preferred to have a film thickness of from about 0.1 micron to 20 microns. As preferred polymers, there are those described in the above cited patent specifications as polymers for the protective polymer layer. Particularly, it is preferred to use polyvinyl chloride, polyvinyl acetate, vinyl chloride-vinyl acetate copolymer, polystyrene, methyl cellulose, ethyl cellulose, cellulose acetate butyrate, vinyl chloride-vinylidene chloride copolymer, carboxy esters, acetyl cellulose, polyvinylidene chloride, polycarbonate, gelatin, polyvinyl alcohol and polyvinyl butyral, etc. It is preferred to harden by an isocyanate group containing compound or another suitable hardening agent.

The membrane or layer containing each component of the present invention and the assistant layer may contain additives known in the field of heat-developable photosensitive materials, for example, plasticizers, matting agents, surface active agents, sensitizers, whitening agents, filter dyes, ultraviolet ray absorbing agents, hardening agents, lubricants and development accelerators, etc. These additives and use of them have been described in *Product Licensing Index,* Vol. 92 (Dec. 1971) No. 9232, page 107, Japanese patent application (OPI) Nos. 33615/78, 119623/75, 57619/75 and 27923/76 and U.S. Pat. Nos. 3,769,019, 3,821,001, 3,667,959, 3,871,887, 3,885,965, 4,021,250 and 4,036,650.

A process for preparing the heat-developable photosensitive material of the present invention is summarized as follows. Namely, an organic silver salt produced by utilizing a known method, after washing, if necessary, with water or alcohol, is converted into silver halide, or a part of the organic silver salt is converted into silver halide, as a preferable process, by a silver halide forming component in the presence of the binder. In the case of using a sensitizing dye, it is preferred to add it in the form of solution to the mixture. The organic silver salt and the silver halide are suitably prepared as a polymer dispersion by dispersing them in a solution of a polymers material which functions as a binder thereafter. This polymer may be added at a suitable time, for example, at preparation of the organic silver salt or at formation of silver halide. The polymer dispersion of the organic silver salt and the silver halide may be molded to form a membrane of applied to a base to form a layer, and other components of the invention are incorporated in a layer provided on said membrane or layer. However, preferably, other components used in the present invention, and, if necessary, the binder is added to the polymer dispersion of the organic silver salt and the silver halide to prepare a heat-developable photosensitive composition, which is then flowed by a known method to form a membrane or applied to a base to form a layer. In order to apply the layer, it is possible to apply various known coating methods, such as a dipping method, an air knife method, a curtain coating method, a hopper coating method, etc. Prior to, simultaneously with, or after the application of the above described composition, the antihalation layer of the present invention and various assistant layers such as a subbing layer or a protective coating layer, etc. can be applied by the similar coating method. If desired, the light bleachable composition of the present invention may be incorporated in the base, by which the base itself can be the antihalation layer.

Though any solvents can be used for the coating solutions, non-combustible solvents as described in British Pat. No. 1,422,145 can be used to avoid the hazard of fire.

If desired, the surface or the back of the base or the layer applied to the base may be subjected to printing, by which printed goods can be used as railway tickets (commutation tickets), postcards and other documents.

The thus produced heat-developable photosensitive material is imagewise exposed to light before or after cutting in a suitable size for using. If desired, it may be preheated (80° C.–140° C.) before exposure. As light sources suitable for imagewise exposing, there are tungsten lamps, fluorescent lamps used for exposing diazo photosensitive materials, mercury lamps, iodine lamps, xenon lamps, CRT (cathode ray tube) and laser light sources, etc. As the original, not only line drawings such as drafts but also photographic images having gradation can be used. Furthermore, it is possible to take a photograph of a human figure or a landscape by means of a camera. As a printing method, it is able to utilize contact printing by superposing the original, reflection printing, and enlargement printing. The exposure varies according to the sensitivity of the photosensitive material. In the case of high sensitivity, it is about 1 lux second, and in case of having a low sensitivity, it is about $10^3$ luxes second. The imagewise exposed photosensitive material can be developed solely by heating (preferably, from about 100° C. to 150° C.). The heating time can be suitably controlled, for example, from 1 second to 60 seconds. It depends upon the heating temperature. Generally, a suitable heating time is from about 5 seconds to 40 seconds at 120° C., from about 2 seconds to 20 seconds at 130° C., and from about 1 second to 10 seconds at 140° C. Various heating means can be used. For example, the photosensitive material may be brought into contact with a heated simple plate or with a heated drum, and, if desired, it is passed through a heated space. Further, it may be heated by high frequency induction heating or by laser beams.

It is then exposed to the light of a mercury lamp or a fluorescent lamp (e.g., for copying) to bleach the antihalation layer. Other light sources may be used for bleaching if they have short wavelengths (generally, less than 500 nm), and the bleaching can be carried out by sunlight or light table (using a fluorescent lamp), or by room light.

The light-bleachable composition of the present invention is easily bleached by light at a high efficiency which does not deteriorate by the lapse of time. Further, it does not have an adverse influence upon photographic properties other than sensitivity, such as heat fog, etc. Accordingly, the heat-developable photosensitive material of the present invention using such a light bleachable composition is very useful.

In the following, the present invention is illustrated in greater detail by reference to examples.

EXAMPLE 1

| | |
|---|---|
| Silver behenate (containing 20% by mol of free stearic acid) | 76 g |
| Polyvinyl butyral | 80 g |
| Isopropyl alcohol | 200 g |
| n-Butyl acetate | 200 g |

The above described composition was dispersed by a homogenizer to prepare a polymer dispersion of silver salt.

This polymer dispersion of silver salt was kept at 50° C. After added the following solution, the mixture was heated to convert a part of silver behenate into silver bromide.

| | |
|---|---|
| N-bromosuccinimide | 4 g |
| Acetone | 100 ml |

The resulted polymer dispersion of silver behenate-silver bromide was kept at 40° C., and the following compounds were added thereto at intervals of 5 minutes in order to prepare a coating solution.

| | | |
|---|---|---|
| (1) | Sodium benzenethiosulfonate (0.05 wt. % solution in ethanol) | 18 ml |
| (2) | Phthalic acid (4 wt. % solution in ethanol) | 25 ml |
| (3) | 3,4-Dichlorobenzoic acid (3 wt. % solution in ethanol) | 25 ml |
| (4) | Reducing agent having the following formula (16 wt. % solution in acetone) | 140 ml |

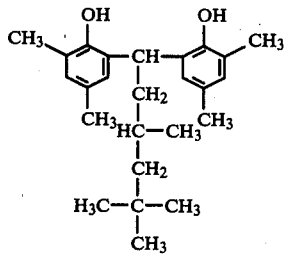

| | | |
|---|---|---|
| (5) | Sensitizing dye (following formula) (0.1 wt. % solution in ethylene glycol monomethyl ether) | 35 ml |

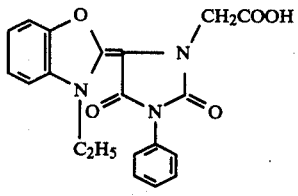

| | | |
|---|---|---|
| (6) | Phthalazinone (toner) (6 wt. % solution in ethylene glycol monomethyl ether) | 140 ml |
| (7) | Hexamethylenediisocyanate (hardening agent) (1 wt. % solution in-butyl acetate) | 40 ml |

The mixture was applied to a polyethylene terephthalate (PET) film base so as to result in a silver content of 1.5 g/m$^2$.

Further, as a protective coating layer, a 2 wt.% solution of cellulose diacetate in acetone was applied to as obtain 0.5 g of the polymer per m$^2$.

Hereinafter, the resulting sheet is referred to as "Photosensitive material A".

On the other hand, to the back of the base of the above described "photosensitive material A," the following light bleachable composition was applied so as to result in a peak absorption density at 490 nm of 0.3. The resulted photosensitive material is called "photosensitive material B".

| | | |
|---|---|---|
| (a) | Polyvinyl butyral | 10 g |
| (b) | The following dye (0.4 wt. % solution in ethylene glycol monomethyl ether) | 8 ml |

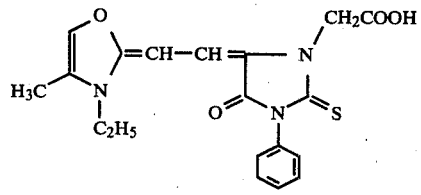

| | | |
|---|---|---|
| (c) | The following compound according to the present invention (0.4 wt. % solution in ethanol) | 16 ml |

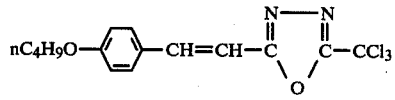

| | | |
|---|---|---|
| (d) | Isopropanol | 30 ml |
| (e) | n-Butyl acetate | 25 ml |

After "photosensitive material A" and "photosensitive material B" were exposed to light using a light source having a maximum intensity at 490 nm (which is 1 kW mercury lamp manufactured and sold by Copyer Co., Ltd. in Japan under trade name of MQW 1300 B), they were developed with heating to 130° C. for 16 seconds. The wedge used was a strip wedge having black intervals of 100μ.

In the developed "photosensitive material A," a considerable degree of blackening was observed on the part corresponding to the black intervals of 100μ of the wedge which, essentially, could not be exposed. It is evidently supposed that development is caused because of exposure to reflection light by halation. On the contrary, in the "photosensitive material B," distinct non-exposed fine lines of 100μ were produced without causing blackening. The image in that state was difficult to see, because the non-exposed parts were colored orange. However, when this "photosensitive material B" was exposed to light with using a 1 kW mercury lamp for 10 seconds at a distance of 10 cm, the orange color was easily bleached to become colorless. Thus, an image having high sharpness could be formed on a light-colored background according to the present invention.

EXAMPLE 2

The following composition was applied to a PET film base so as to result in the peak absorption density at 456 nm of 0.4, instead of the light bleachable composition in Example 1. This photosensitive material is called "Photosensitive material C".

| | | |
|---|---|---|
| (a) | Cellulose diacetate | 5.6 g |
| (b) | The following dye (Merocyanine dye according to the present invention) (0.3 wt. % solution in ethylene glycol monomehtyl ether) | 10 ml |

-continued

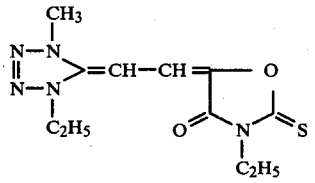

(c) Halogen containing compound according to the present invention (the following formula) (0.3 wt. % solution in ethanol) 30 ml

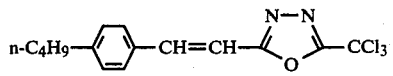

(d) Solvent:
Acetone 60 ml
Ethylene glycol monomethyl ether 4 ml

After "photosensitive material A" and "photosensitive material C" were exposed to light using a light source having a maximum intensity at 456 nm (which is 1 kW mercury lamp manufactured and sold by Copyer Co., Ltd. in Japan under trade name of MQW 1300 B), they were developed by heating to 130° C. for 16 seconds. The wedge used was a strip wedge having black intervals of 100 μm.

In the developed "photosensitive material A", a considerable degree of blackening was observed on the part corresponding to the black intervals of 100 μm of the wedge which would not be essentially exposed to light. On the contrary, in the "photosensitive material C," distinct while fine lines of 100 μm were reproduced without causing the blackening. Then, this "photosensitive material C" was exposed to light using a 1 kW high pressure mercury lamp for 13 second at a distance of 10 cm, by which colored parts were bleached. Thus, an image having high sharpness was obtained on the light-colored background according to the present invention.

EXAMPLE 3

The following composition was applied to a PET film base instead of the light bleachable composition in Example 1 such that the peak absorption density at 486 nm was 0.3.

This photosensitive material is called "photosensitive material D."

(a) Cellulose diacetate 5.6 g
(b) The following dye (Merocyanine dye according to the present invention) (0.3 wt. % solution in ethylene glycol monomehtyl ether) 10 ml

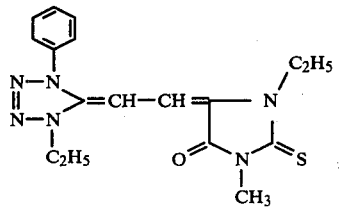

(c) Halogen containing compound according to the present invention (the following formula) (0.3 wt. % solution in ethanol) 30 ml -continued

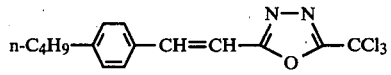

(d) Solvent:
Acetone 60 ml
Ethylene glycol monomethyl ether 4 ml

After "photosensitive material A" and "photosensitive material D" were exposed to light using a light source having a maximum intensity at 486 nm (which is 1 kW mercury lamp manufactured and sold by Copyer Co., Ltd. in Japan under trade name of MQW 1300 B), they were developed by heating to 130° C., for 16 seconds. The wedge used was a strip wedge having black intervals of 100 μm.

In the developed "photosensitive material A," a considerable degree of blackening was observed on the part corresponding to the black intervals of 100 μm of the wedge which, essentially, could not be exposed to light. On the contrary, in the "photosensitive material D," distinct fine white lines of 100 μm were reproduced without causing such blackening. Then, this "photosensitive material D" was exposed to light using a 1 kW high pressure mercury lamp for 12 seconds at a distance of 10 cm, by which colored parts were bleached. Thus, an image having high sharpness was obtained on the lightcolored background according to the present invention.

EXAMPLE 4

The following composition was applied to a PET film base instead of the light bleachable composition in Example 1 such that the peak adsorption density at 470 nm was 0.3.

This photosensitive material is called "photosensitive material E."

(a) Cellulose diacetate 5.6 g
(b) The following dye (Merocyanine dye according to the present invention) (0.3 wt. % solution in ethylene glycol monomethyl ether) 10 ml

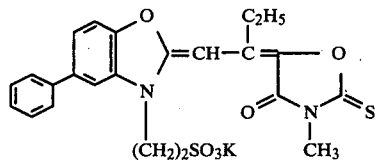

(c) Halogen containing compound according to the present invention (the following formula) (0.3 wt. % solution in ethanol) 30 ml

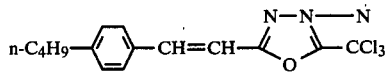

(d) Solvent
Acetone 60 ml
Ethylene glycol monomethyl ether 4 ml

After "photosensitive material A" and "photosensitive material E" were exposed to light using a light source having a maximum intensity at 472 nm (which is 1 kW mercury lamp manufactured and sold by Copyer Co., Ltd. in Japan under trade name of MQW 1300 B), they were developed by heating to 130° C. for 16 seconds. The wedge used was a strip wedge having black intervals of 100 μm.

In the developed "photosensitive material A", a considerable degree of blackening was observed on the part corresponding to the black intervals of 100 μm of the wedge which essentially could not be exposed to light. On the contrary, in the "photosensitive material E", distinct fine white lines of 100 μm were reproduced without causing such blackening. Then this "photosensitive material E" was exposed to light with using a 1 kW high pressure mercury lamp for 12 seconds at a distance of 10 cm, by which colored parts were bleached. Thus an image having high sharpness was obtained on a light-colored background according to the present invention.

EXAMPLE 5

The following composition was applied to a PET film base instead of the light bleachable composition in Example 1 such that the peak absorption density at 454 nm was 0.3.

This photosensitive material is called "photosensitive material F."

| | |
|---|---|
| (a) Cellulose diacetate | 5.6 g |
| (b) The following dye (merocyanine dye according to the present invention) (0.3 wt. % solution in ethylene glycol monomethyl ether) | 10 ml |

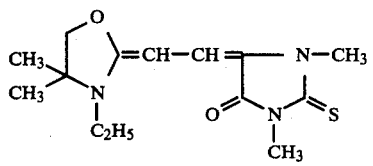

| | |
|---|---|
| (c) Halogen containing compound of the present invention (the following formula) (0.3 wt. % solution in ethanol) | 30 ml |

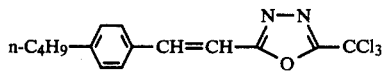

| | |
|---|---|
| (d) Solvent | |
| Acetone | 60 ml |
| Ethylene glycol monomethyl ether | 4 ml |

After "photosensitive material A" and "photosensitive material F" were exposed to light using a light source having a maximum intensity at 454 nm (which is 1 kW mercury lamp manufactured and sold by Copyer Co., Ltd. in Japan under trade name of MQW 1300 B), they were developed by heating to 130° C. for 16 seconds. The wedge used was a strip wedge having black intervals of 100 μm.

In the developed "photosensitive material A", a considerable degree of blackening was observed on the part corresponding to the black intervals of 100 μm of the wedge which essentially could not be exposed to light. On the contrary, in the "photosensitive material F," distinct white fine lines of 100 μm were reproduced without causing such blackening. Then this "photosensitive material F" was exposed to light with using a 1 kW high pressure mercury lamp for 12 seconds at a distance of 10 cm, by which the colored parts were bleached. Thus an image having high sharpness was obtained on a light-colored background according to the present invention.

EXAMPLE 6

The following composition was applied to a PET film base instead of the light bleachable composition in Example 1 such that the peak absorption density at 488 nm was 0.3.

This photosensitive material is called "photosensitive material G".

| | |
|---|---|
| (a) Cellulose diacetate | 5.6 g |
| (b) The following dye (merocyanine dye according to the present invention) (0.3 wt. % solution in ethylene glycol monomethyl ether) | 10 ml |

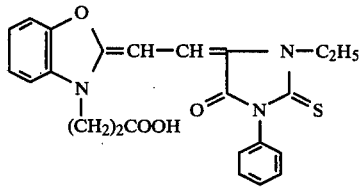

| | |
|---|---|
| (c) Halogen containing compound according to the present invention (the following formula) (0.3 wt. % solution in ethanol) | 30 ml |

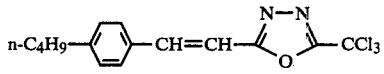

| | |
|---|---|
| (d) Solvent | |
| Acetone | 60 ml |
| Ethylene glycol monomethyl ether | 4 ml |

After "photosensitive material A" and "photosensitive material G" were exposed to light using a light source having a maximum intensity at 488 nm (which is 1 kW mercury lamp manufactured and sold by Copyer Co., Ltd. in Japan under trade name of MQW 1300 B), they were developed by heating to 130° C. for 16 seconds. The wedge used was a strip wedge having black intervals of 100 μm.

In the developed "photosensitive material A", a considerable degree of blackening was observed on the part corresponding to the black intervals of 100 μm of the wedge which, essentially, could not be exposed to light. On the contrary, in the "photosensitive material G," distinct white fine lines of 100 μm were reproduced without causing such blackening. Then this "photosensitive material G" was exposed to light using a 1 kW high pressure mercury lamp for 12 seconds at a distance of 10 cm, by which the colored parts were bleached. Thus an image having high sharpness was obtained on a light-colored background according to the present invention.

EXAMPLE 7

The following composition was applied to a PET film base instead of the light bleachable composition in Example 1 such that the peak absorption density at 454 nm was 0.3.

This photosensitive material is called "photosensitive material H".

| | |
|---|---|
| (a) Cellulose diacetate | 5.6 g |
| (b) The following dye (merocyanine dye of the present invention) (0.3 wt. % solution in ethylene glycol monomethyl ether) | 10 ml |

-continued

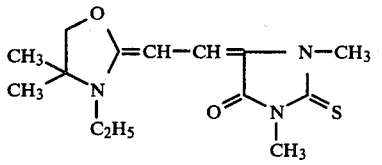

| | | |
|---|---|---|
| (c) | Halogen containing compound according to the present invention (the following formula) (0.3 wt. % solution in methyl ethyl ketone) | 30 ml |

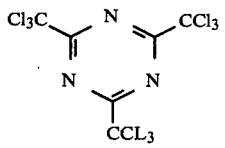

| | | |
|---|---|---|
| (d) | Solvent | |
| | Acetone | 60 ml |
| | Ethylene glycol monomethyl ether | 4 ml |

After "photosensitive material A" and "photosensitive material H" were exposed to light using a light source having a maximum intensity at 454 nm (which is 1 kW mercury lamp manufactured and sold by Copyer Co., Ltd. in Japan under trade name of MQW 1300 B), they were developed by heating to 130° C. for 16 seconds. The wedge used was a strip wedge having black intervals of 100 μm.

In the developed "photosensitive material A," a considerable degree of blackening was observed on the part corresponding to the black intervals of 100 μm of the wedge which could not be essentially exposed to light. On the contrary, in the "photosensitive material H," distinct white fine lines of 100 μm were reproduced without causing such blackening. Then this "photosensitive material H" was exposed to light with using a 1 kW high pressure mercury lamp for 12 seconds at a distance of 10 cm, by which colored parts were bleached. Thus an image having high sharpness was obtained on a light-colored background according to the present invention.

EXAMPLE 8

The following composition was applied to a PET film base instead of the light bleachable composition in Example 1 such that the peak absorption density at 454 nm was 0.3.

This photosensitive material is called "photosensitive material I."

| | | |
|---|---|---|
| (a) | Cellulose diacetate | 5.6 g |
| (b) | The following dye (merocyanine dye of the present invention) (0.3 wt. % solution in ethylene glycol monomethyl ether) | 10 ml |

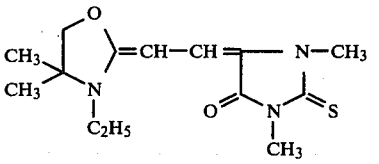

| | | |
|---|---|---|
| (c) | Halogen containing compound according to the present invention (the following formula) (0.3 wt. % solution in methyl ethyl ketone) | 30 ml |

-continued

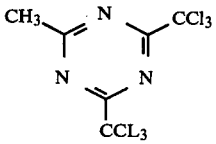

| | | |
|---|---|---|
| (d) | Solvent | |
| | Acetone | 60 ml |
| | Ethylene glycol monomethyl ether | 4 ml |

After "photosensitive material A" and "photosensitive material I" were exposed to light with using a light source having a maximum intensity at 454 nm (which is 1 KW mercury lamp manufactured and sold by Copyer Co., Ltd. in Japan under trade name of MQW 1300 B), they were developed by heating to 130° C. for 16 seconds. The wedge used was a strip wedge having black intervals of 100 μm.

In the developed "photosensitive material A," a considerable degree of blackening was observed on the part corresponding to the black intervals of 100 μm of the wedge which, essentially, could not be exposed to light. On the contrary, in the "photosensitive material I," distinct white fine lines of 100 μm were reproduced without causing such blackening. Then this "photosensitive material T" was exposed to light with using a 1 kW high pressure mercury lamp for 12 seconds at a distance of 10 cm, by which the colored parts were bleached. Thus an image having high sharpness was obtained on a light-colored background according to the present invention.

EXAMPLE 9

The following composition was applied to a PET film base instead of the light bleachable composition in Example such that the peak absorption density at 454 nm was 0.3.

This photosensitive material is called "photosensitive material J."

| | | |
|---|---|---|
| (a) | Cellulose diacetate | 5.6 g |
| (b) | The following dye (merocyanine dye of the present invention) (0.3 wt. % solution in ethylene glycol monomethyl ether) | 10 ml |

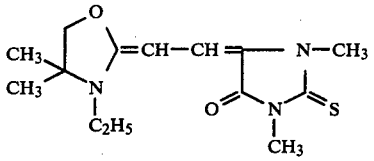

| | | |
|---|---|---|
| (c) | Halogen containing compound according to the present invention (the following formula) (0.3 wt. % solution in methyl ethyl ketone) | 30 ml |

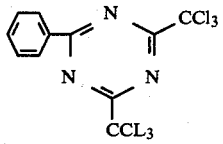

| | | |
|---|---|---|
| (d) | Solvent | |
| | Acetone | 60 ml |

-continued

| | |
|---|---|
| Ethylene glycol monomethyl ether | 4 ml |

After "photosensitive material A" and "photosensitive material J" were exposed to light using a light source having a maximum intensity at 454 nm (which is 1 kW mercury lamp manufactured and sold by Copyer Co., Ltd. in Japan under trade name of MQW 1300 B), they were developed by heating to 130° C. for 16 seconds. The wedge used was a strip wedge having black intervals of 100 μm.

In the developed "photosensitive material A," a considerable degree of blackening was observed on the part corresponding to the black intervals of 100 μm of the wedge which , essentially, could not be exposed to light. On the contrary, in the "photosensitive material J," distinct white fine lines of 100 μm were reproduced without causing such blackening. Then this "photosensitive material J" was exposed to light using a 1 kW high pressure mercury lamp for 12 seconds at a distance of 10 cm, by which the colored parts were bleached. Thus an image having high sharpness was obtained on a light-colored background according to the present invention.

While the invention has been described in detail and with reference to specific embodiments thereof, it will be apparent to one skilled in the art that various changes and modifications can be made therein without departing from the spirit and scope thereof.

What is claimed is:

1. A heat-developable photosensitive material is described comprising a heat-developable photosensitive layer containing at least an organic silver salt, a photocatalyst, and a reducing agent, wherein the improvement is an antihalation layer comprising a light bleachable colored composition composed of at least (1) a photosensitive halogen-containing compound, and (2) a merocyanine dye, provided on the opposite side of said heat-developable photosensitive layer with respect to the side intended for imagewise exposure, said photosensitive halogen-containing compound (1) forming a halogen radical or hydrohalogenic acid by light decomposition thereof and said photosensitive halogen-containing compound being selected from the group consisting of:

compounds represented by Formula (III)

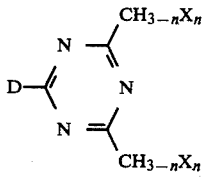

(III)

wherein D represents an alkyl group having from 1 to 5 carbon atoms, which may be substituted with halogen atoms, or an aryl group having from 6 to 10 carbon atoms, and n represents an integer of 1 to 3; and compounds represented by Formula (IV)

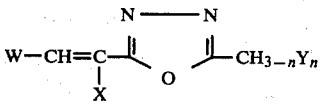

(IV)

wherein W represents a substituted or unsubstituted phenyl group or a substituted or unsubstituted naphthyl group, wherein the phenyl group may be substituted with halogen atoms, nitro group, a cyano group, an alkyl group having from 1 to 3 carbon atoms or an alkoxy group having from 1 to 4 carbon atoms, or the phenyl group has the structure

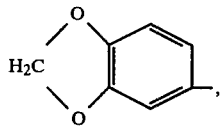

the number of substituents is 1 or 2 in the case of halogen atoms, and is 1 in other cases, X represents hydrogen, an alkyl group having from 1 to 3 carbon atoms, or phenyl group, Y represents a halogen atom, and n represents an integer of 1 to 3.

2. A heat-developable photosensitive material as in claim 1, wherein said merocyanine dye has a resonant structure that can be represented by

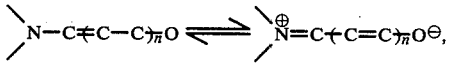

wherein n is a positive integer, the dye has an absorption region in the sensitive wavelength range of the heat-developable photosensitive layer, and the merocyanine dye has a nucleus selected from the group consisting of a thiazoline nucleus, a oxazoline nucleus, a pyrroline nucleus, a pyridine nucleus, an oxazole nucleus, a thiazole nucleus, a selenazole nucleus, a tetrazole nucleus, or an imidazole nucleus as the basic nucleus, and a thiohydantoin nucleus, a rhodanine nucleus, an oxazolidinedione nucleus, a thiazolidinedione nucleus, a barbituric acid nucleus, a thiazolinone nucleus, a malonitrile nucleus, and a pyrazolone nucleus as an acid nucleus.

3. A heat-developable photosensitive material as in claim 2, wherein said merocyanine dye has a resonant structure that can be represented by

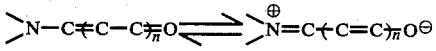

wherein n is a positive integer, the dye has an absorption region in the sensitive wavelength range of the heat-developable photosensitive layer, and the merocyanine dye has a nucleus selected from the group consisting of a thiazoline nucleus, an oxazoline nucleus, a pyrroline nucleus, a pyridine nucleus, an oxazole nucleus, a thiazole nucleus, a selenazole nucleus, a tetrazole nucleus, or an imidazole nucleus as the basic nucleus, and a thiohydantoin nucleus, a rhodanine nucleus, an oxazolidinedone nucleus, a thiazolidinedione nucleus, a barbituric acid nucleus, a thiazolinone nucleus, a malonitrile nucleus, and a pyrazolone nucleus as an acid nucleus.

4. A heat-developable photosensitive material as in claim 1, 2, or 3, wherein the merocyanine dye is incorporated in the antihalation layer in an amount sufficient to make the transmission optical density of the antihalation layer at least 0.1 and the reflection optical density at least 0.05.

5. A heat-developable photosensitive material as in claim 1, 2, or 3, wherein the merocyanine dye is incorporated in the antihalation layer in an amount sufficient to make the transmission optical density of the antihalation layer at least 0.3 and the reflection optical density at least 0.1.

6. A heat-developable photosensitive material as in claim 4, wherein the photosensitive halogen-containing compound is present in the antihalation layer in an amount of from 0.1 mol to 100 mols per mol of the merocyanine dye.

7. A heat-developable photosensitive material as in claim 5, wherein the photosensitive halogen-containing compound is present in the antihalation layer in an amount of from 0.1 mol to 100 mols per mol of the merocyanine dye.

8. A heat-developable photosensitive material as in claim 4, wherein the photosensitive halogen-containing compound is present in the antihalation layer in an amount of from 1 mol to 10 mols per mol of the merocyanine dye.

9. A heat-developable photosensitive material as in claim 5, wherein the photosensitive halogen-containing compound is present in the antihalation layer in an amount of from 1 mol to 10 mols per mol of the merocyanine dye.

10. A heat-developable photosensitive material as in claim 1 wherein said photosensitive halogen-containing compound is represented by formula (III).

11. A heat-developable photosensitive material as in claim 1 wherein said photosensitive halogen-containing compound is represented by formula (IV).

12. A heat-developable photosensitive material as in claim 10 wherein said photosensitive halogen-containing compound is selected from the group consisting of 2,4-bis(tribromomethyl)-6-methyltriazine, 2,4,6-tris(dibromomethyl)triazine, 2,4,6-tris(tribromomethyl)triazine, 2,4,6-tris(trichloromethyl)triazine, 2,4-bis(trichloromethyl)-6-methyltriazine, and 2,4-bis(trichloromethyl)-6-phenyltriazine.

13. A heat-developable photosensitive material as in claim 1 wherein said photosensitive halogen-containing compound is selected from the group consisting of

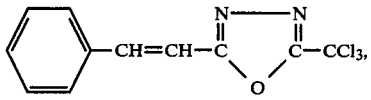

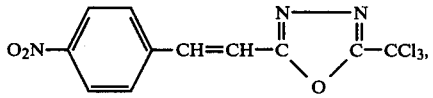

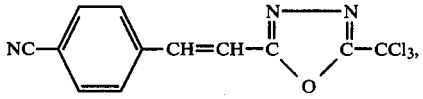

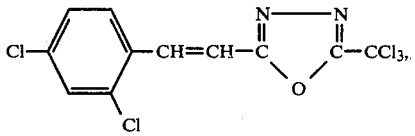

-continued

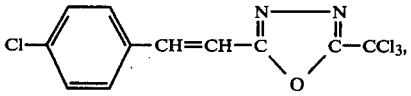

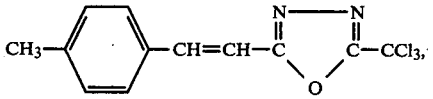

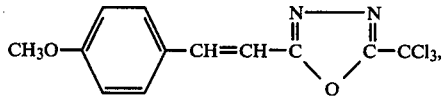

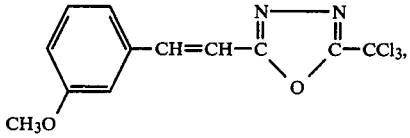

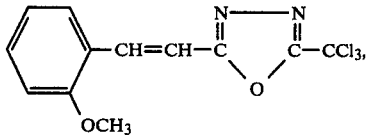

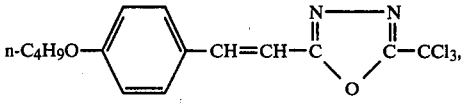

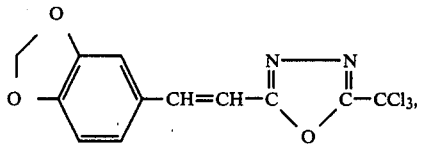

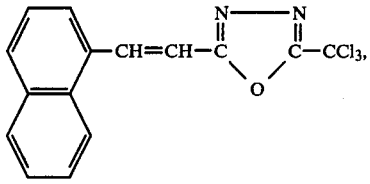

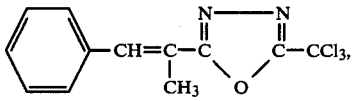

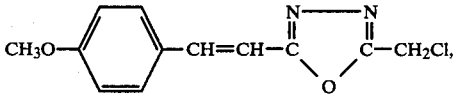

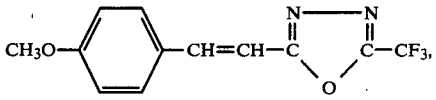

-continued
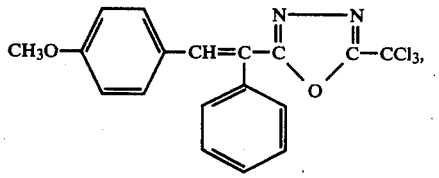
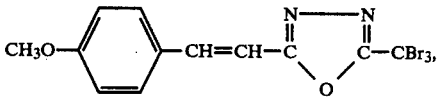
-continued
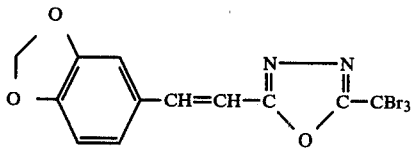
and
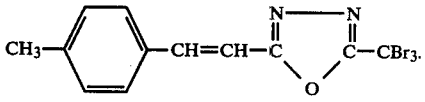
* * * * *